US008617290B2

(12) United States Patent
Byun et al.

(10) Patent No.: US 8,617,290 B2
(45) Date of Patent: Dec. 31, 2013

(54) METHOD FOR MANUFACTURING FE—SI ALLOY POWDERS

(75) Inventors: Ji-Young Byun, Seoul (KR); Yoon-Bae Kim, Seoul (KR); Hyun-Kwang Seok, Seoul (KR); Jang-Won Kim, Seoul (KR); Dow-Bin Hyun, Seoul (KR); Heon-Phil Ha, Seoul (KR); Do-Hyung Kim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 444 days.

(21) Appl. No.: 12/909,914

(22) Filed: Oct. 22, 2010

(65) Prior Publication Data

US 2011/0094338 A1 Apr. 28, 2011

(30) Foreign Application Priority Data

Oct. 22, 2009 (KR) ..... 10-2009-0100778
Oct. 21, 2010 (KR) ..... 10-2010-0103015

(51) Int. Cl.
*B22F 9/16* (2006.01)

(52) U.S. Cl.
USPC ..... 75/349; 75/348; 75/350; 75/351

(58) Field of Classification Search
USPC ..... 75/230, 245, 246, 255, 252, 343, 345, 75/347–351, 363–365, 370–372, 10.15, 75/10.16, 10.17, 10.67; 148/300–311, 148/320–337; 420/117, 118
See application file for complete search history.

(56) References Cited

FOREIGN PATENT DOCUMENTS

| | | | | |
|---|---|---|---|---|
| JP | 62-027501 | * | 2/1987 | ..... B22F 1/00 |
| JP | 2005-146315 | | 6/2005 | |
| JP | 2007-031831 | | 2/2007 | |
| JP | 2007-146254 | | 6/2007 | |
| KR | 10-2009-0078858 | | 7/2009 | |

OTHER PUBLICATIONS

Full professional English translation of JP 62-027501 (Matsumoto et al.), published originally in the Japanese language on Feb. 5, 1987.*

* cited by examiner

*Primary Examiner* — Scott Kastler
*Assistant Examiner* — Vanessa Luk
(74) *Attorney, Agent, or Firm* — Lexyoume IP Meister, PLLC.

(57) ABSTRACT

The present invention relates to a method for manufacturing a Fe—Si alloy powder. A method for manufacturing a Fe—Si alloy powder includes: providing a mixture of an $Al_2O_3$ powder, an active agent powder, a Si powder, and a Fe powder; heating the mixture with a temperature of 700° C. to 1200° C. in the hydrogen atomosphere; magnetically separating a Fe-containing material from the mixture; and separating a Fe—Si alloy powder by soaking the Fe-containing material in an alkali solution. In the heating of the mixture, the Si powder is deposited on the surface of the Fe powder and diffused into the Fe powder.

11 Claims, 6 Drawing Sheets

METHOD FOR MANUFACTURING FE—SI ALLOY POWDERS

CROSS-REFERENCE TO RELATED APPLICATION

This application claims priority to and the benefit of Korean Patent Application Nos. 10-2009-0100778 and 10-2010-0103015 filed in the Korean Intellectual Property Office on Oct. 22, 2009 and Oct. 21, 2010, the entire contents of which are incorporated herein by reference.

BACKGROUND OF THE INVENTION (a) Field of the Invention

The present invention relates to a Fe—Si alloy powder. More particularly, the present invention relates to a method for further easily manufacturing a Fe—Si alloy powder.

(b) Description of the Related Art

A Fe—Si alloy, that is, silicon steel is a soft magnetic material with excellent permeability and electrical conductivity so that it is used as an iron core of various electric devices such as a transformer, a generator, a motor, and a switch power. In order to manufacture as an iron core, the Fe—Si alloy is manufactured in the form of a sheet or a powder. The sheet-shaped Fe—Si alloy is classified into an oriented silicon steel sheet plate and a non-oriented silicon steel sheet. Since the amount of silicon in the oriented silicon steel sheet is about 3 wt %, the core loss is low and thus the oriented silicon steel sheet is used as an iron core of a transformer. When a soft magnetic material with a low core loss is used as a material or a rechargeable battery or a motor applied to an electric vehicle, energy loss can be reduced and energy efficiency in driving of the motor can be increased. However, the oriented silicon steel sheet cannot be used as a material or a rotor due to magnetic anisotropy. On the contrary, the non-oriented silicon steel sheet has low spatial anisotropy of magnetic, and therefore it is usually used in a rotor of an electromotor.

The silicon steel has a magnetic characteristic that is changed according to the amount of silicon. When the silicon contains 6.5 wt % is Si, the silicon has large electrical resistance and therefore a current loss among the core loss is decreased and the core loss at high frequency is decreased. In addition, magnetostriction is reduced so that noise and vibration can be reduced. However, when the amount of Si in the silicon steel is increased, the silicon steel becomes fragile so that cold rolling of the silicon steel cannot be easily performed. Thus, the silicon steel containing a large amount of Si is manufactured by manufacturing a silicon steel sheet of 3 wt % and then adding silicon to the silicon steel sheet.

A silicon steel containing silicon of less than 3 wt % is used as a representative soft magnetic material in an iron core of various electric devices such as a transformer, a generator, a motor, or a switch power. The silicon steel is relatively inexpensive compared to other soft magnetic materials such as pure iron, Ni—Fe, and Fe—Al—Si and has an excellent magnetic characteristic so that it has high utility.

It is well known that the core loss is decreased when the amount of Si in the silicon steel is increased. This is because that magnetic anisotropy and crystalline anisotropy of the silicon steel are decreased and electrical resistance is increased as the amount of Si is increased. When the amount of silicon in the silicon steel is increased from 3 wt % to 6.5 wt %, the current low is rapidly decreased while the electric resistance is increased from 48 μΩ·m to 82 μΩ·m, and the core loss in high frequency is decreased and the magnetostriction becomes close to zero. Accordingly, noise and vibration can be reduced so that the Fe—Si alloy containing silicon of 6.5 wt % is almost an ideal soft magnet alloy. However, when the amount of silicon is increased, the alloy becomes fragile so that silicon steel containing silicon of higher than 4 wt % cannot be easily cold-rolled.

In order to solve such formability of the silicon steel, a powder core is used. However, a powder core for silicon-rich silicon steel has bad formability and therefore the concentration of the powder core is decreased due to deformation deterioration during compression molding. A Fe—Si alloy powder can be manufactured using grinding, gas spraying, and mechanical alloying, but the gas spraying is generally used in consideration of the shape of the powder and economic efficiency of the process.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a method for manufacturing a Fe—Si alloy powder by diffusing Si using a fluoride active agent powder. In addition, the present invention provides a method for manufacturing a Fe—Si alloy powder including 0.1 wt % to 33 wt % of Si using a mixed powder including an inactive powder, a fluoride active agent powder, a Si powder, and a Fe powder.

A method for manufacturing a Fe—Si alloy powder according to an exemplary embodiment of the present invention includes: providing a mixture of an $Al_2O_3$ powder, an active agent powder, a Si powder, and a Fe powder; heating the mixture with a temperature of 700° C. to 1200° C. in the hydrogen atomosphere; magnetic separating a Fe-containing material from the mixture; and separating a Fe—Si alloy powder by soaking the Fe-containing material in an alkali solution. In the heating of the mixture, the Si powder may be deposited on the surface of the Fe powder and diffused into the Fe powder.

In the providing of the mixture, the active agent powder may include at least one of compounds selected from a group consisting of an alkali metal fluoride, an alkaline earth metal fluoride, $NH_4F$, $AlF_3$, and $CuF_2$, and the amount of the active agent powder in the mixture is 0.1 wt % to 5.0 wt %. In the providing of the mixture, the amount (wt %) of the Si powder with respect to the sum of the amount (wt %) of the Fe powder and the amount (wt %) of the Si powder may be 0.001 to 0.34. The amount (wt %) of the Fe powder with respect to the amount (wt %) of the $Al_2O_3$ powder may be 0.5 to 2.0. In the separating of the Fe—Si alloy powder, alkali included in the alkali solution may include at least one of compounds selected from a group consisting of NaOH and KOH. The concentration degree of the alkali in the alkali solution may be 0.1 wt % to 40 wt %.

A method for manufacturing a Fe—Si alloy powder according to another exemplary embodiment of the present invention includes: providing a mixed powder of an inactive powder, a fluoride active agent powder, a Si powder, and a Fe powder; heating the mixed powder in the hydrogen atomosphere; cooling the heated mixed powder; and separating a Fe—Si alloy powder from the mixed powder by size distributing and magnetic separating the mixed powder.

In the providing of the mixed powder, the inactive powder may be at least one of compounds selected from a group consisting of $Al_2O_3$, $SiO_2$, MgO, and $Si_3N_4$, and the particle size of the inactive powder is smaller than that of the Fe powder. In the providing of the mixed powder, the fluoride active agent powder may be at least one of compounds selected from a group consisting of an alkali metal fluoride, an alkaline earth metal fluoride, $NH_4F$, $AlF_3$, and $CuF_2$, and the amount of fluoride active agent powder is 0.1 wt % to 5 wt % of the mixed powder. The amount of the fluoride active agent powder may be 3 wt % to 4 wt % of the mixed powder.

In the providing of the mixed powder, a ratio of the mass of the Si powder with respect to the sum of the mass of the Si powder and the mass of the Fe powder may be 0.001 to 0.34. In the separating of the Fe—Si alloy powder from the mixed powder, the amount of Si in the Fe—Si alloy powder may be 0.1 wt % to 34 wt %.

In the providing of the mixed powder, a ratio of the mass of the inactive powder with respect to the mass of the Fe powder may be 0.5 to 2.0. In the heating of the mixed powder in the hydrogen atomosphere, the mixed powder may be heated with a temperature of 700° C. to 1200° C.

A Fe—Si alloy powder with an average size of less than 100 μm can be manufactured at a relatively low temperature. Thus, a core loss in parts where the Fe—Si alloy powder is used can be significantly reduced. In addition, the amount of Si included in the Fe—Si alloy powder can be controlled within a range of 0.1 wt % to 33 wt %. A Fe—Si alloy powder can be easily manufactured at a relatively low temperature using a mixed powder of an inactive powder, a fluoride active agent powder, a Si powder, and a Fe powder without using specific equipment. Accordingly, manufacturing cost of silicon steel can be reduced. Further, a Fe—Si alloy powder can be used in powder core manufacturing by forming the Fe—Si alloy powder including Si of 0.1 wt % to 33 wt % at a relatively low temperature.

DETAILED DESCRIPTION OF THE EMBODIMENTS

Terminologies used herein are provided to merely mention specific exemplary embodiments and are not intended to limit the present invention. Singular expressions used herein include plurals unless they have definitely opposite meanings. The meaning of "including" used in this specification gives shape to specific characteristics, regions, positive numbers, steps, operations, elements, and/or components, and do not exclude the existence or addition of other specific characteristics, regions, positive numbers, steps, operations, elements, components, and/or groups.

All the terminologies including technical terms and scientific terms used herein have the same meanings that those skilled in the art generally understand. Terms defined in dictionaries are construed to have meanings corresponding to related technical documents and the present description, and they are not construed as ideal or very official meanings, if not defined.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
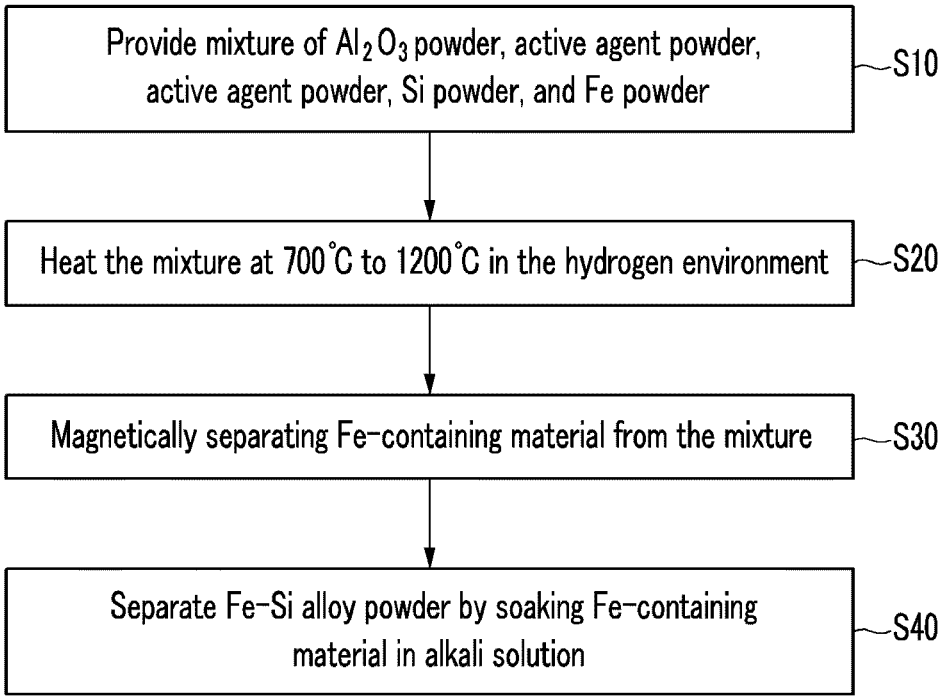
FIG. 1 is a schematic flow chart of a method for manufacturing a Fe—Si alloy powder according to an exemplary embodiment of the present invention.

FIG. 1 is a schematic flow chart of a method for manufacturing a Fe—Si alloy powder according to an exemplary embodiment of the present invention. FIG. 1 exemplarily illustrates a method for manufacturing a Fe—Si alloy powder, and the present invention is not limited thereto. Thus, the Fe—Si alloy powder manufacturing method may be variously modified.

As shown in FIG. 1, the method of manufacturing a Fe—Si alloy powder includes i) providing a mixture of an $Al_2O_3$ powder, an active agent powder, a Si powder and a Fe powder, ii) heating the mixture with a temperature between 700° C. to 1200° C. in the hydrogen atomosphere, iii) magnetically separating a Fe-containing material from the mixture, and iv) separating the Fe—Si alloy powder by soaking the Fe-containing material in alkali solution. Alternatively, the method for manufacturing Fe—Si alloy powder may further include other processes as necessary.

First, in the step of S10, a mixture of an $Al_2O_3$ powder, an active agent powder, a Si powder, and a Fe powder is provided. The mixture is manufactured by rotating a mixture with a proper ratio in a rotatable mixture such as alumina.

The $Al_2O_3$ powder prevents sintering of the Fe powder and the Si powder because the Fe powder and the Si powder are sintered and a bulk-state alloy is obtained from the sintering when the two powders are reacted with each other. Thus, the Fe powder and the Si powder are separated from each other by using a sufficient amount of $Al_2O_3$ powders to prevent occurrence of sintering in the two powders.

The active agent powder makes the Fe powder and the Si powder separated from each other by $Al_2O_3$ powder react with each other in the step of S20. As the active agent powder, a compound of an alkali metal fluoride, an alkaline metal earth fluoride, $NH_4F$, $AlF_3$, or $CuF_2$ may be used. The amount of the active agent powder in the mixture may be 0.1 wt % to 5.0 wt %. An excessive amount of the active agent powder increases the reaction rate. In addition, if the amount of the active agent powder is too small, the reaction rate is decreased. Thus, the reaction rate can be controlled by controlling the amount of active agent powder. Preferably, the amount of active agent powder may be 1 wt % to 4 wt %.

The Fe powder may be manufactured using various methods such as a carbonyl method or a wet method. The amount of Si contained in the Fe—Si alloy powder can be controlled by controlling the amount of Si powder with respect to the amount of Fe powder. That is, the amount (wt %) of Si powder with respect to the sum of the amount (wt %) of Fe powder and the amount (wt %) of Si powder may be 0.001 to 0.34. If the amount (wt %) of Si powder is too large, the magnetic property may be extinguished so that the magnetic separating cannot be performed. In addition, if the amount (wt %) of Si powder is too small, it is not applicable to be used as the Fe—Si alloy powder.

The ratio of the amount (wt %) of Fe powder with respect to the amount (wt %) of $Al_2O_3$ powder may be 0.5 to 2.0. If the ratio is too low, the amount of the $Al_2O_3$ powder is excessive so that the diffusion rate of a Si-containing gas generated from the Si powder toward the Fe surface is decreased. As a result, the reaction rate is deteriorated. Furthermore, the separation effect by the $Al_2O_3$ powder is insignificant so that the use amount of the $Al_2O_3$ powder is increased. On the contrary, if the ratio is too high, the amount of the $Al_2O_3$ powder is too small so that the Fe powder and the Si powder are sintered together and thus the powder size is increased.

As shown in FIG. 1, in the step of S20, the mixture is heated at a temperature of 700° C. to 1200° C. in the hydrogen atmosphere. Such a temperature range is lower than the melting point of Fe or Si, and a vapor pressure of Fe or Si as well. As a result, the Fe and the Si have no chance to meet each other, and therefore any reaction may not proceed. Thus, the reaction may proceed to get a desired result using the active agent powder. Here, if the heating temperature of the mixture is too low, the reaction rate is rapidly decreased. In addition, if the heating temperature is too high, the mixture is sintered so that the particle can be larged. Thus, it is preferred to control the heating temperature within the industrially controllable range.

The reaction time of the mixture is proportional to a reaction temperature. If the reaction temperature is increased, the diffusion rate of the Si-containing gas generated from the Si is increased so that a diffusion rate between the Fe powder and the Si powder is also increased. As a result, the reaction time can be reduced. If a molar fraction of the amount of the Si contained in the Fe—Si alloy powder is 8.35% to 10.41% and a mutual diffusion coefficient is expressed by Aexp[-Q/RT], A is 1.52 $cm^2/s$ to 1.87 $cm^2/s$ and activation energy Q is 211 kJ/mol to 215 kJ/mol. Here, R denotes a gas constant and T denotes an absolute temperature.

Referring to the above-stated description, the Si diffusion time to the inside of a Fe particle with a diameter of 50 μm is 25.5 hours at 800° C., 3.4 hours at 900° C., and 0.15 hours at 1100° C. Composition in the Fe—Si alloy powder can be uniform by maintaining the reaction time to be longer than the diffusion time.

The Fe powder is alloyed and thus the Fe—Si alloy powder is generated when the $Al_2O_3$ powder, the active agent powder, the Si powder, and the Fe powder are reacted with each other by heating the mixture within the above-state temperature range. The active agent powder is reacted with the Si powder to generate various compounds such as SiF, $SiF_2$, $SiF_3$, $SiF_4$, $SiH_2F_2$, $SiH_3F$, and $SiH_4$. The compounds move to the surface of the Fe powder through pores existing in the mixture of the $Al_2O_3$ powder and the active agent powder.

In the mixture, activity of the Si powder is 1 and the activity is always higher than that of the Si in the Fe—Si alloy powder. Thus, a partial pressure difference occurs in the Si-containing gas, and gases involved in the Si deposition move to the surface of the Fe powder from the surface of the Si powder.

Thus, the gas may be self-decomposed or Si is deposited on the surface of the Fe powder by the reduction of hydrogen. The deposited Si is diffused into the Fe powder by the concentration difference such that the Fe—Si alloy powder is manufactured. Until the Si powder is exhausted, the reaction continuously proceeds.

In the step of S30, Fe-containing materials are magnetically separated from the mixture. Since the Fe—Si alloy powder is magnetized, the Fe containing materials containing the Fe—Si alloy powder can be magnetically separated. Since a FeSi phase has magnetism in the Fe—Si alloy powder, 33 wt % of Si should be eliminated in the Fe—Si alloy powder for magnetic separation. In the step of S20, the mixture is heated and maintained at high temperature, and therefore the Fe-containing materials can be magnetically separated from the mixture after putting the mixture into the water or cooling at room temperature.

In the step of S40, the Fe—Si alloy powders are separated by soaking the Fe-containing material into the alkali solution. A small amount of $Al_2O_3$ powder is included in the Fe-containing material. Thus, the $Al_2O_3$ powder is eliminated using the alkali solution.

Here, KOH or NAOH may be used as alkali included in the alkali solution. The concentration degree of the alkali in the alkali solution may be 0.1 wt % to 40 wt %. An excessive amount of alkali causes oxidation of the Fe—Si alloy powder surface. In addition, if the amount of alkali is too small, alumina remains with the Fe—Si alloy powder.

In the step of S40, the amount of Si included in the finally separated Fe—Si alloy powder can be controlled by controlling the amount of Fe and Si powders in the mixture provided in the step of S10. That is, the amount of Si powder in the Fe—Si alloy powder can be increased to 67 mol %. That is, the amount of Si powder can be increased to be enough to form a $FeSi_2$ phase.

The amount of Si in the acquired Fe—Si alloy powder is preferably in a range from 1 wt % to 7 wt %. If the amount of the Si is too high or too low, the core loss is increased. Thus, it is preferred to control the amount of Si included in the Fe—Si alloy powder within the above-stated range.

On the contrary, when the Fe—Si alloy powder is manufactured using an atomizing method, it is difficult to make an average particle size of not more than 100 μm. That is, it is difficult to control the particle size of the Fe—Si alloy powder. In addition, When using the atomizing method, too much energy is consumed to heat the silicon steel at temperature of 1550° C. for melting. Further, equipment only for the atomizing is required.

Figure 2:
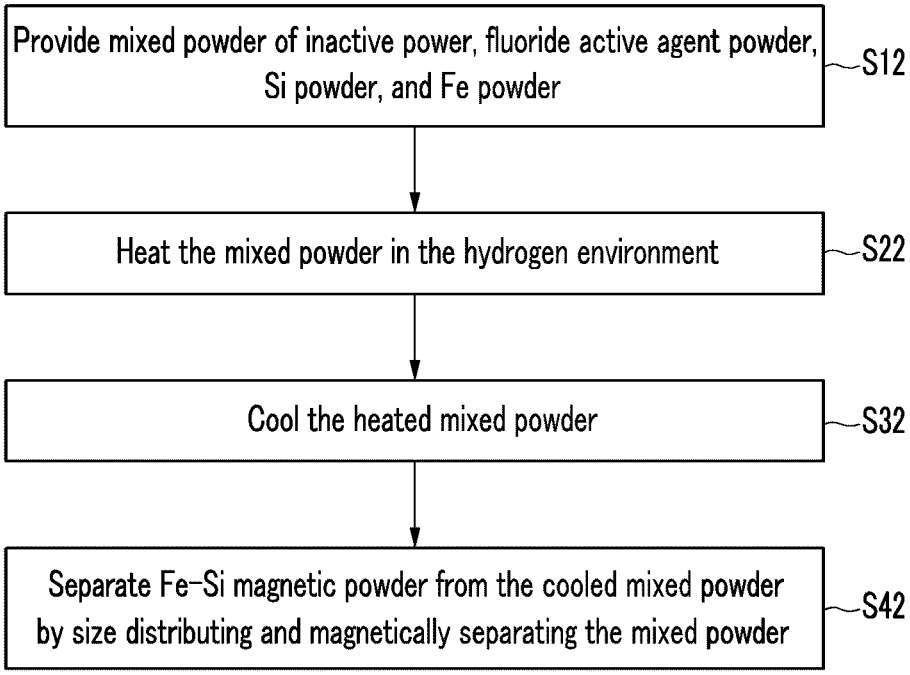
FIG. 2 is a schematic flow chart of a method for manufacturing a Fe—Si alloy powder according to another exemplary embodiment of the present invention.

FIG. 2 is a schematic flow chart of a method for manufacturing a Fe—Si alloy powder according to another exemplary embodiment of the present invention. FIG. 2 is merely to illustrate a method for manufacturing a Fe—Si alloy powder, and the present invention is not limited thereto. Thus, the method for manufacturing a Fe—Si alloy powder may be variously modified.

As shown in FIG. 2, the method for manufacturing a Fe—Si alloy powder includes i) providing a mixed powder of an inactive powder, a fluoride active agent powder, a Si powder, and a Fe powder (S12), ii) heating the mixed powder in the hydrogen atomosphere (S22), iii) cooling the heated mixed powder (S32), and iv) separating a Fe—Si alloy powder from the cooled mixed powder by size distributing and magnetically separating the mixed powder (S42). Alternatively, the method may further include other steps.

In the step of S12, the mixture powder of the inactive powder, the fluoride active agent powder, the Si powder, and the Fe powder is provided. When the Fe powder and the Si powder are reacted with each other by mixing them, the Fe—Si alloy can be acquired but the alloy is in the bulk state rather than in the powder state by sintering, and therefore sintering of the Fe powder and the Si powder should be prevented. For this purpose, the inactive powder that does not react with the Fe powder and the Si powder is added. $Al_2O_3$, $SiO_2$, MgO, or $Si_3N_4$ may be exemplarily used as the inactive powder.

For example, when $Al_2O_3$ is used as the inactive powder, a Fe powder, and a Si powder are separated from each other using the $Al_2O_3$ powder by sufficiently increasing the amount of $Al_2O_3$ powder in a mixed powder of the $Al_2O_3$ powder, the Fe powder, and the Si powder. In this case, sintering does occur between the Fe powder and the Si powder even though the mixed powder is heated to be maintained at high temperature of 1000° C. in the step of S22.

In addition, the particle size of the inactive powder is smaller than that of the Fe powder. Thus, when an inactive powder of which a particle size is equal to or smaller than that of the Fe powder is used, the sintering of the Fe or Fe—Si alloy powder can be prevented by using the inactive powder.

A ratio of the mass of the inactive powder with respect to the mass of the Fe powder may be 0.5 to 2.0. If the ratio is too small, the Fe powders contact with each other to be sintered, thereby causing the powder size to be increased. On the contrary, if the ratio is too large, a distance for diffusion of the Si-containing gases generated from the Si powder is increased, thereby moving speed of the Si-containing gases toward a surface of Fe by diffusion is reduced due to a large amount of the inactive powder. As a result, the reaction rate for forming the Fe—Si alloy is decreased, and furthermore, the separation effect by the inactive powder becomes insignificant so that the use amount of the inactive powder is increased.

Meanwhile, the Fe powder and the Si powder should react with each other to form the Fe—Si alloy powder, and therefore an alkali metal fluoride, an alkaline earth metal fluoride, $NH_4F$, $AlF_3$, or $CuF_2$ are used as the fluoride active agent powder. The separated Fe powder and Si powder are reacted with each other by the inactive powder by providing several amount of the fluoride active agent powder.

Here, the amount of fluoride active agent powder may be 0.1 wt % to 5 wt % of the amount of the mixed powder. If the amount of the fluoride active agent powder is too small, generating amount of Si-containing gas is small, thereby supplying rate of the Si-containing gas toward the surface of Fe and then reaction rate is reduced. In addition, if an amount of fluoride active agent powder is over a predetermined amount, reacting rate is saturated. The predetermined amount thereof may be little different depending on a type of fluoride. The predetermined amount thereof may be in a range from 3 wt % to 4 wt %. Thus, the amount of the fluoride active agent powder is controlled within the above-stated range. Preferably, the amount of fluoride active agent powder is controlled to be 1 wt % to 4 wt % of the mixed powder for constant reaction rate.

A ratio of the mass of the Si powder with respect to the sum of the mass of the Si powder and the mass of the Fe powder may be 0.001 to 0.34. If the ratio is too small, the amount of Si included in the finally manufactured Fe—Si alloy powder is too low so that an effect of reducing core loss by adding Si in the silicon steel made of the Fe—Si alloy powder cannot be obtained. On the contrary, if the ratio is too high, the amount of Si included in the finally manufactured Fe—Si alloy powder is great so that the silicon steel made of the Fe—Si alloy powder is weak, thereby causing deterioration of formability and magnetic property as well. Therefore, the amount of Si powder is controlled within the above-stated range.

Considering that the Fe—Si alloy powder is partially lost due to volatilization of Si-containing gases in the step of S42, the amount of Si added to the mixed powder is slightly much more than the required amount. For example, when manufacturing a Fe—Si alloy powder containing 3 wt % of Si, a ratio of the mass of the Si powder with respect to the sum of the mass of the Si powder and the mass of the Fe powder can be controlled to be about 3.2 wt % when manufacturing the mixed powder.

A process for providing the Si powder and the Fe powder is well known to a person skilled in the art, and therefore no further description will be provided. The inactive powder, the fluoride active agent powder, the Si powder, and the Fe powder are put in a rotatable mixer with an appropriate ratio and mixed to manufacture the mixed powder.

Next, in the step of S22 shown in FIG. 2, the mixed powder is heated in the hydrogen atmosphere. That is, the mixed powder is put in a container such as an alumina to be heated in the hydrogen atmosphere. In this case, the Si powder and the fluoride active agent powder are reacted with each other such that various compounds including Si and a fluorine, such as $SiF_4$, $SiF_3$, $SiF_2$, SiF, $SiHF_3$, $SiH_2F_2$, $SiH_3F$, and $SiH_4$ are formed.

The compounds move to the surface of the Fe powder through pores in the mixed powder, and silicon is deposited on the surface of the Fe powder by analysis reaction at the surface of the Fe powder and reduction by hydrogen. The deposited silicon is diffused into the Fe powder by the concentration difference such that the Fe—Si alloy powder is manufactured. Meanwhile, since Si in the mixed powder is maintained in the pure state, activity of Si becomes 1 and the value is higher than that of Si in the Fe—Si alloy powder. Thus, a partial pressure difference occurs in the Si-containing gases, and gases involved in the Si deposition move to the surface of the Fe powder from the surface of the Si powder. Accordingly, a chemical reaction between the Fe powder and the Si powder continuously proceeds until the Si powder is exhausted.

Here, the mixed powder may be heated with a temperature between 700° C. to 1200° C. If the heating temperature of the mixed powder is too low, the reaction rate of the Fe powder and the Si powder is rapidly decreased. If the heating temperature is too high, the Fe powder and the Si powder are sintered with each other so that the particle size may be increased. Thus, it is preferred to heat the mixed powder with a temperature within the above-stated range.

When the reaction temperature is increased as the heating temperature is increased, the diffusion rate of the Si-containing gases is increased so that the diffusion rate between the Fe powder and the Si powder is increased as well. Thus, the reaction time may be reduced. When a mutual diffusion coefficient is expressed by Aexp[-Q/RT] and the amount of Si in the Fe—Si alloy is between 8.35 mol % to 10.41 mol %, A is 1.52 $cm^2/s$ to 1.87 $cm^2/s$ and activation energy Q is 211 kJ/mol to 215 kJ/mol. Here, R denotes gas and T denotes an absolute temperature. It takes 102 hours at 800° C., 13.2 hours at 900° C., and 0.6 hours at 1100° C. for diffusion of Si into an iron particle having a diameter 2 r of 100 μm based on the mutual diffusion coefficient [t, time (sec)]. Thus, composition in the Fe—Si alloy powder can be uniform by extending the reaction time at each temperature. Unlikely, the reaction time may be controlled according to the diameter of the iron particle. For example, when the diameter of the iron particle is decreased to be less than 100 μm, the heating time should be reduced and, when the diameter of the iron diameter exceeds 100 μm, the heating time should be increased.

For manufacturing of a soft magnetic Fe—Si alloy powder used as a powder core, a gay spraying method is conventionally used. In this case, a process for heating and melting silicon steel over a melting point of about 1550° C. is included, and accordingly the energy use amount is increased and equipment for gas spraying is required. However, the present exemplary embodiment uses a chemical reaction at low temperature, and therefore the Fe—Si alloy powder can be easily manufactured by heating the mixed powder up to 1200° C.

In the step S32 of FIG. 2, the heated mixed powder is cooled. That is, the temperature of the mixed powder is cooled to the room temperature.

Finally, in the S42 of FIG. 2, the cooled mixed powders are size distributed and magnetically separated to separate the Fe—Si alloy powder from the mixed powder. The mixed powders generated from the reaction include a Fe—Si alloy powder, the inactive powder, an unreacted Si, and an unreacted active agent.

Most of the Si and active agent are participated in the reaction and then consumed, and therefore, the amount of unreacted Si and the amount of unreacted active agent are negligible. For example, fluorine included in the fluoride active agent powder is vaporized during the reaction. Thus, the separation of the Fe—Si alloy powder from the inactive powder is only focused. The inactive powder is an oxide of which a melting point is high, and therefore it is ignored that the inactive powder is sintered at the reaction temperature in the step of S22. In addition, the sintering degree is very weak even though the inactive powder is partially sintered. In this state, Fe—Si alloy is separated from the mixed powder by simply sifting and magnetically separating the mixed powder. An efficiency of sifting and magnetic separation can be enhanced only by lightly ball milling by using plastic balls even if the mixed powder is lightly sintered. That is, separation efficiency can be increased even by lightly breaking the mixed powder by using other methods instead of light ball milling. The above method is well known to a person skilled in the art, and therefore no further description will be provided.

In addition, the Fe—Si alloy powder can be separated by simply size distributing the mixed powder by controlling the particle size of materials used in the reaction. That is, when the mixed powder is size distributed using a sieve of an appropriate size, Fe-So alloy powder remains on the sieve and the inactive powder is passed through the sieve and eliminated. When both of the size distribution and magnetic separation are performed, the Fe—Si alloy powder can be effectively separated. That is, since the manufactured Fe—Si alloy powder has magnetism, the Fe—Si alloy powder can be separated from the mixed powder by magnetic separation.

In the Fe—Si alloys, it is preferred to control the amount of Si in the Fe—Si alloy powder to be 33 wt % because a FeSi phase has magnetism. The core loss is decreased as the amount of Si is increased in the Fe—Si alloy, and the core loss becomes the minimum when the amount of Si is 6.5 wt %. When the amount of Si is higher than 6.5 wt %, the core loss is increased and therefore, the amount of Si is preferably less than 10.0 wt %.

The amount of Si in the manufactured Fe—Si alloy powder may be 0.1 wt % to 34 wt %. That is, the amount of Si in the Fe—Si alloy powder can be controlled to be included within the above-stated range by controlling the amount of Si powder with respect to the Fe powder in S12. As a result, Fe—Si alloy powder having excellent magnetic anisotropy, crystalline anisotropy, and formability can be manufactured. Meanwhile, the amount of Si in the Fe—Si alloy powder can be decreased to 67 mol %. That is, the amount of Si can be increased to be enough to form a $FeSi_2$ phase.

Hereinafter, the present invention will be described in further detail through experimental examples. The experimental examples are exemplarily provided for the present invention, and the present invention is not limited thereto.

Experimental Example

First Experimental Example

A 50 g of mixture of an $Al_2O_3$ powder, a NaF powder, a Si powder, and a Fe powder are manufactured. In the mixture, the amount of NaF powder was 1 wt %, the amount of Fe powder was 25 g, and the Si(wt %)/[Fe(wt %)+Si(wt %)] was 6%. The mixture was put in an alumina crucible and reacted for 24 hours at 900° C. in the hydrogen atomosphere. After cooling the reacted mixture to room temperature, the mixture was charged in the water and magnetically separated to acquire a material attached to the magnet. Next, the material was reacted in 5 wt % of NaOH solution for 8 hours to manufacture a Fe—Si alloy powder.

Experiment Result of the First Experimental Example

Fe—Si Alloy Powder Component Analysis

Figure 3:
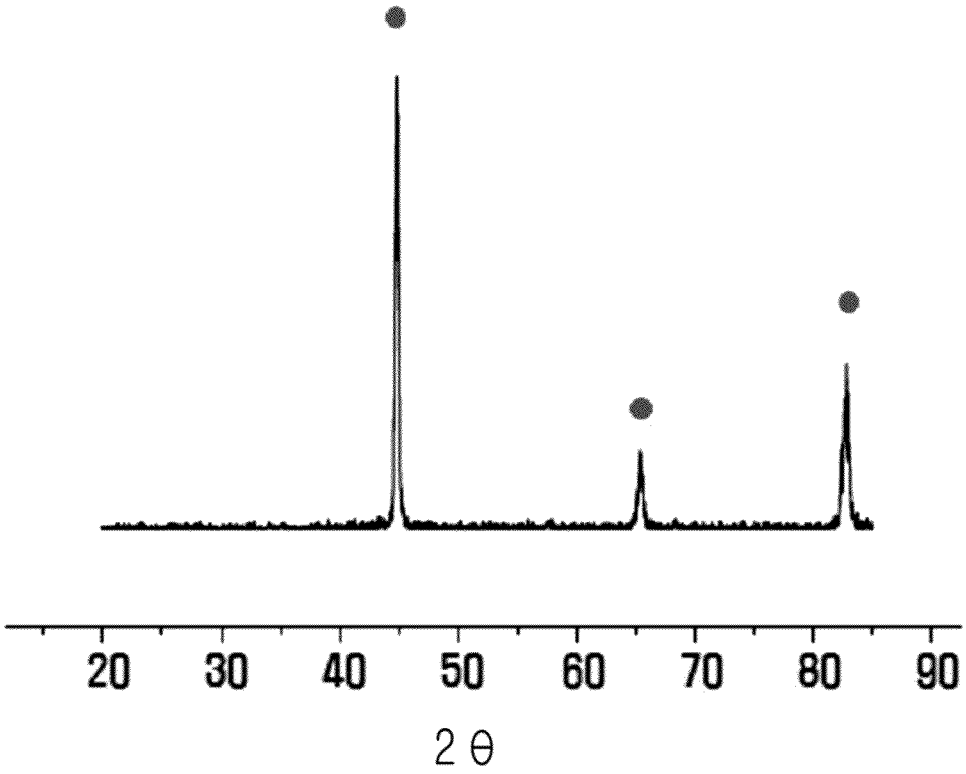
FIG. 3 is a X-ray diffraction graph of a Fe—Si alloy powder manufactured according to a first experimental example of the present invention.

FIG. 3 shows an X-ray diffraction graph of the Fe—Si alloy powder manufactured according to the first experimental example.

As shown in FIG. 3, an analysis result of the Fe—Si alloy powder using an electron probe micro analyzer (EPMA) showed that an outer or inner side of the powder contained 5.91 wt % of Si. That is, the outer side or inner side of the powder has the same content. This value was lower than the content of added Si, that is, 6 wt %.

Fe—Si Alloy Powder Particle Size Analysis

The particle size of the Fe powder that is a raw material of the mixture and the particle size of the Fe—Si alloy powder manufactured according to the first experimental example were compared. 79.2 wt % of the Fe powder was passed through the #400 sieve (38 μm), and 20.8 wt % of the Fe powder was passed between #400 sieve (38 μm) and #200 sieve (75 μm). Compared with this, 61.9 wt % of the Fe—Si alloy powder manufactured according to the first experimental example was passed through the #400 sieve (38 μm), and 38.1 wt % was passed between the #400 sieve (38 μm) and #200 sieve (75 μm). This is shown in Table 1.

TABLE 1

| NO | Pass percentage | #400 sieve (38 μm) | Between #400 sieve (38 μm) and #200 sieve (75 μm) |
|---|---|---|---|
| 1 | Fe powder (raw material) | 79.2 wt % | 20.8 wt % |
| 2 | Fe—Si alloy powder of the first experimental example | 61.9 wt % | 38.1 wt % |

As shown in Table 1, the particle size of the Fe—Si alloy powder was increased by sintering through the alloying process. However, the particle size of the Fe—Si alloy powder of the first experimental example was similar to that of the raw material powder.

Figure 4:
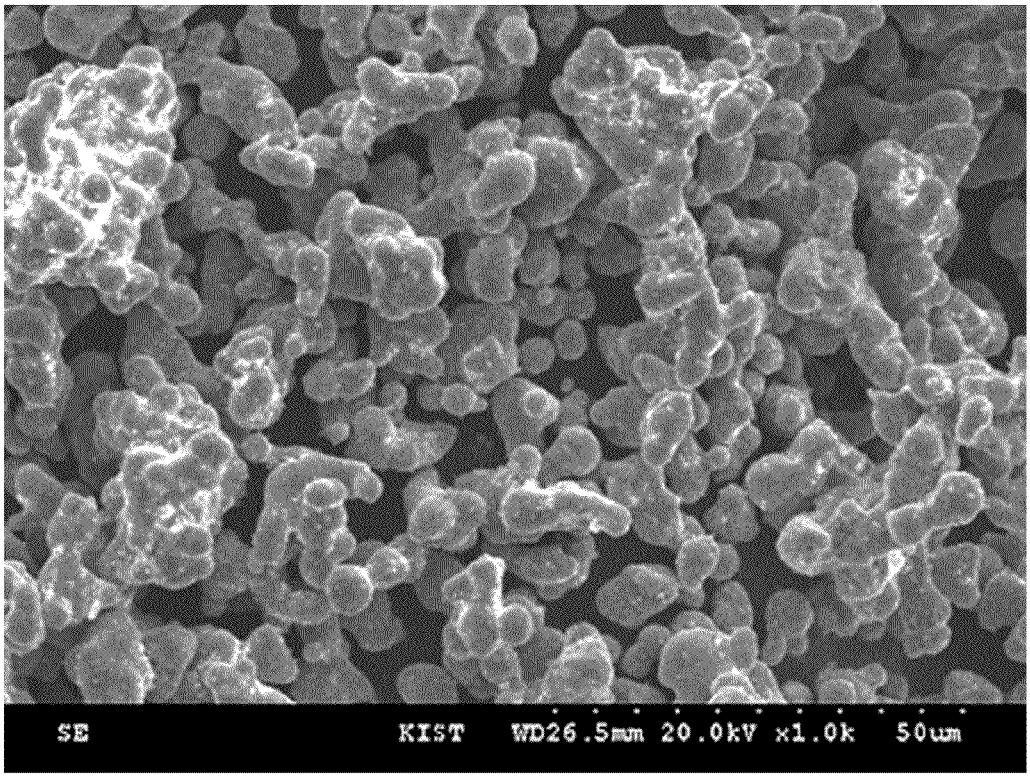
FIG. 4 is a scanning electron microscopic photo of the Fe—Si alloy powder manufactured according to the first experimental example of the present invention.

FIG. 4 shows a scanning electron microscopic photo of the Fe—Si alloy powder manufactured according to the experimental example.

As shown in FIG. 4, fine particles included in the Fe—Si alloy powder were found. It can be determined that the fine particles were partially sintered through observation of the surface shape of the fine particles. An average particle size of the Fe—Si alloy powder was 45 μm to 50 μm.

Second Experimental Example

In a mixture, Si(wt %)/[Fe(wt %)+Si(wt %)] was 2%. Excluding this, a Fe—Si alloy powder was manufactured using the same method of the first experimental example.

Third Experimental Example

In a mixture, Si(wt %)/[Fe(wt %)+Si(wt %)] was 3%. Excluding this, a Fe—Si alloy powder was manufactured using the same method of the first experimental example.

Fourth Experimental Example

In a mixture, Si(wt %)/[Fe(wt %)+Si(wt %)] was 4%. Excluding this, a Fe—Si alloy powder was manufactured using the same method of the first experimental example.

Fifth Experimental Example

In a mixture, Si(wt %)/[Fe(wt %)+Si(wt %)] was 5%. Excluding this, a Fe—Si alloy powder was manufactured using the same method of the first experimental example.

Sixth Experimental Example

In a mixture, Si(wt %)/[Fe(wt %)+Si(wt %)] was 7%. Excluding this, a Fe—Si alloy powder was manufactured using the same method of the first experimental example.

Result of the Second to Sixth Experimental Example

The content of Si contained in the Fe—Si alloy powder according to results of the second to sixth experimental examples is shown in Table 2.

TABLE 2

| | Experimental Example | | | | |
|---|---|---|---|---|---|
| | second experimental example | third experimental example | fourth experimental example | fifth experimental example | sixth experimental example |
| Si(wt %)/ [Fe(wt %) + Si(wt %)] | 2% | 3% | 4% | 5% | 7% |
| Si content | 1.95 wt % | 3.00 wt % | 3.87 wt % | 4.92 wt % | 6.85 wt % |

As shown in Table 2, the content of Si in the Fe—Si alloy powder was linearly increased as the Si(wt %)/[Fe(wt %)+Si(wt %)] was increased. Here, the content of Si in the Fe—Si alloy powder was smaller by 0.1 wt % than that of Si according to calculation of Si(wt %)/[Fe(wt %)+Si(wt %)].

Seventh Experimental Example

A mixture of a $Al_2O_3$ powder, a NaF powder, a Si powder, and a Fe powder was manufactured. In the mixture, the amount of NaF powder was 1 wt %, the amount of Fe powder was 25 g, and the Si(wt %)/[Fe(wt %)+Si(wt %)] was 7%. The mixture was put in an alumina crucible and reacted for 24 hours at 900° C. in the hydrogen atomosphere. Other experiment condition was the same as that of the first experimental example.

Eighth Experimental Example

The mixture was put in the alumina crucible and reacted for 24 hours at 950° C. in the hydrogen atomosphere. Other experiment condition was the same as that of the seventh experimental example.

Ninth Experimental Example

The mixture was put in the alumina crucible and reacted for 24 hours at 1000° C. in the hydrogen atomosphere. Other experiment condition was the same as that of the seventh experimental example.

Tenth Experimental Example

The mixture was put in the alumina crucible and reacted for 24 hours at 1050° C. in the hydrogen atomosphere. Other experiment condition was the same as that of the seventh experimental example.

Result of Seventh Experimental Example to Tenth Experimental Example

The particle sizes of Fe—Si alloy powders manufactured according to the seventh to the tenth experimental examples were compared with each other. 67.5%, 63.2%, 49.5%, and 43.6% of the Fe—Si alloy powders were respectively passed through the #400 sieve (38 μm). This is shown in Table 3.

TABLE 3

| | Experimental Example | | | |
|---|---|---|---|---|
| | Seventh Experimental Example | Eighth Experimental Example | Ninth Experimental Example | Tenth Experimental Example |
| Percentage of Fe—Si alloy powder passing through #400 sieve (38 μm) | 67.5% | 63.2% | 49.5% | 43.6% |

As shown in Table 3, the percentages of the Fe—Si alloy powder passing through the #400 sieve (38 μm) were significantly low in ninth Experimental Example and the tenth Experimental Example compared to the seventh Experimental Example and the eighth Experimental Example. Thus, when the reaction temperature is higher than 1000° C. in the hydrogen atomosphere as in the ninth Experimental Example and the tenth Experimental Example, the Fe—Si alloy powder was rapidly sintered and the particle size was increased.

Eleventh Experimental Example

A mixture 50 g of an $Al_2O_3$ powder, a NaF powder, a Si powder, and a Fe powder was manufactured. In the mixture, the amount of NaF powder was 1 wt %, the amount of Fe powder was 25 g, and Si(wt %)/[Fe(wt %)+Si(wt %)] was 6%. A weight ratio of the Fe powder with respect to the $Al_2O_3$ powder was 1/0.5. Other experiment condition was the same as that of the first experimental example.

Twelfth Experimental Example

A mixture 50 g of an $Al_2O_3$ powder, a NaF powder, a Si powder, and a Fe powder was manufactured. In the mixture, the amount of NaF powder was 1 wt %, the amount of Fe powder was 25 g, and Si(wt %)/[Fe(wt %)+Si(wt %)] was 6%. In addition, a weight ratio of the Fe powder with respect to the $Al_2O_3$ powder was 1/2. Other experiment condition was the same as that of the eleventh experimental example.

Result of the Eleventh Experimental Example and the Twelfth Experimental Example The particle sizes of Fe—Si alloy powders manufactured according to the eleventh and the twelfth experimental examples were compared with each other. 38.2% and 68.3% of the Fe—Si alloy powders were respectively passed through the #400 sieve (38 μm). Meanwhile, a weight ratio of the Fe powder with respect to the Al2O3 powder in the first Experimental Example was 25/22.9, that is, approximately 1/0.9. This is shown in Table 4.

TABLE 4

| | Experimental Example | | |
|---|---|---|---|
| | First Experimental Example | Eleventh Experimental Example | Twelfth Experimental Example |
| Weight ratio of Fe powder with respect to $Al_2O_3$ powder | 1/0.9 | 1/0.5 | 1/2 |
| Percentage of Fe—Si alloy powder passing through #400 sieve (38 μm) | 61.9% | 38.2% | 68.3% |

As shown in Table 4, when the amount of $Al_2O_3$ powder is smaller than the amount of Fe powder, the $Al_2O_3$ powder cannot separate the Fe powders, for example, in the eleventh Experimental Example. Accordingly, the mixture was more easily sintered.

Thirteenth Experimental Example $Al_2O_3$ was used as an inactive powder and NaF was used as a fluoride active agent powder. A mixed powder was manufactured by mixing the $Al_2O_3$ powder, the NaF powder, the Si powder, and the Fe powder. In the mixed powder, the amount of NaF was 1 wt %, a mass ratio of the Si powder with respect to the sum of the mass of the Si powder and the mass of the Fe powder was 4.2%. In addition, the use amount of Fe powder was 25 g. The size of the $Al_2O_3$ powder was less than 35 μm, and the size of the Si powder was less than 45 μm. A water spray powder of Höganäs was used as the Fe powder, and the Fe powder was size distributed and a Fe powder having a particle size of 45 μm to 75 μm is size distributed to be used as a raw material. The mixed powder of 50 g was put in the alumina crucible and reacted for 24 hours at 900° C. in the hydrogen atomosphere. Next, the mixed powder was cooled to the room temperature and then slightly ball-milled for 30 minutes using a plastic ball. The ball-milled mixed powder was size distributed and magnetically separated to manufacture a Fe—Si alloy powder. Other condition is well known to a person skilled in the art, and therefore no further description will be provided.

Fourteenth Experimental Example

A Fe—Si alloy powder was manufactured while changing a ratio of the mass of the Si powder with respect to the sum of the Si powder and the mass of the Fe powder in the mixed powder from 3.0 to 6.5. Here, when the ratio was 3.0, the amount of Si was about 2.65 wt %. In addition, when the ratio was 6.5, the amount of Si was about 6.15 wt %. The ratios of the mass of the Si powder with respect to the sum of the Si powder and the mass of the Fe powder were respectively 3.0, 4.2, and 6.5, and reaction was performed at 1000° C. in the hydrogen atomosphere. Other experiment condition was the same as that of the thirteenth experimental example.

Fifteenth Experimental Example

Instead of using an $Al_2O_3$ powder, a $Si_3N_4$ powder was used as an inactive powder. Since the particle size of the $Si_3N_4$ powder is less than 3 μm, it was expected that the Fe—Si alloy powder would be easily separated by sieving and magnetic separation. Other experimental condition was the same as that of the thirteenth Experimental Example.

Experiment Result

Result of the Thirteenth Experimental Example

Figure 5:
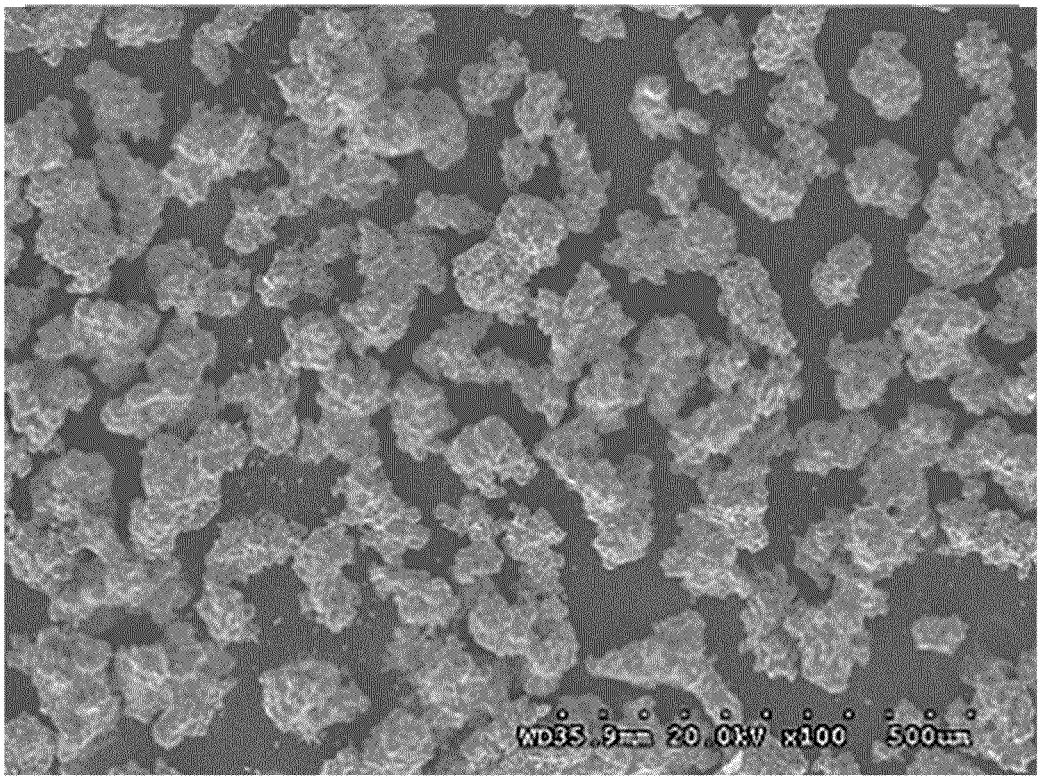
FIG. 5 is a scanning electron microscopic photo of a Fe—Si alloy powder manufactured according to a thirteenth experimental example of the present invention.

FIG. 5 shows a scanning electron microscope (SEM) photo of the Fe—Si alloy powder manufactured according to the thirteenth experimental example.

As shown in FIG. 5, a result of analyzing the particle size of the Fe—Si alloy powder shows that the Fe—Si alloy powder has 65.8 wt % of size distribution with the particle size between 45 μm to 75 μm, 22.0 wt % between 75 μm to 90 μm, 8.3 wt % between 90 μm to 106 μm, 2.7 wt % between 106 μm to 125 μm, and 1.2 wt % between 12 μm to 150 μm. An average particle size calculated from this was 65.6 μm, which is 9.3% larger than that of the Fe powder used for manufacturing the mixed powder. The result showed that sintering was effectively prevented by the $Al_2O_3$ powder even though the sintering was unavoidable in some degree when the Fe—Si alloy powder was manufactured according to the first experimental example.

Meanwhile, the same content was observed in the outer side or inner side of the powder according to an analysis result using an electron probe micro analyzer (EPMA). That is, the contents in the inner and outer sides of the powder were uniform, and 4.0 wt % of Si, that is, lower than 4.2 wt % of Si included in the mixed powder was observed. This is presumed that Si is partially lost by being mixed in the gas.

Result of the Fourteenth Experimental Example

The concentration degrees of Si in the manufactured Fe—Si alloy powder were respectively 2.86 wt %, 4.09 wt %, and 6.30 wt %. Although a ratio of the mass of the Si powder with respect to the sum of the mass of the Si powder and the mass of the Fe powder in the mixed powder are equivalent to each other, the concentration degree of the Si in the Fe—Si alloy powder was increased when the reaction temperature was increased to 1000° C. The result showed that a loss of Si can be reduced when the sold-state diffusion is increased as the temperature is increased.

Result of the Fifteenth Experimental Example

The amount of Si in the manufactured Fe—Si alloy powder was 4.05 wt %.

Comparative Example

A mixture of 50 g was manufactured by mixing an $Al_2O_3$ powder, a NaF powder, a Si powder, and a Fe powder. In the mixture, the amount of NaF powder was 1 wt %, the amount of Fe powder was 25 g, and Si(wt %)/[Fe(wt %)+Si(wt %)] was 6%. The mixture was put in an alumina crucible, and reacted for 24 hours at 900° C. in the hydrogen atomosphere. The reaction-completed mixture is cooled to the room temperature, and charged in the water to acquire a material attached to a magnet by magnetic separation. The material was not additionally treated with alkali.

Result of Comparative Example

Figure 6:
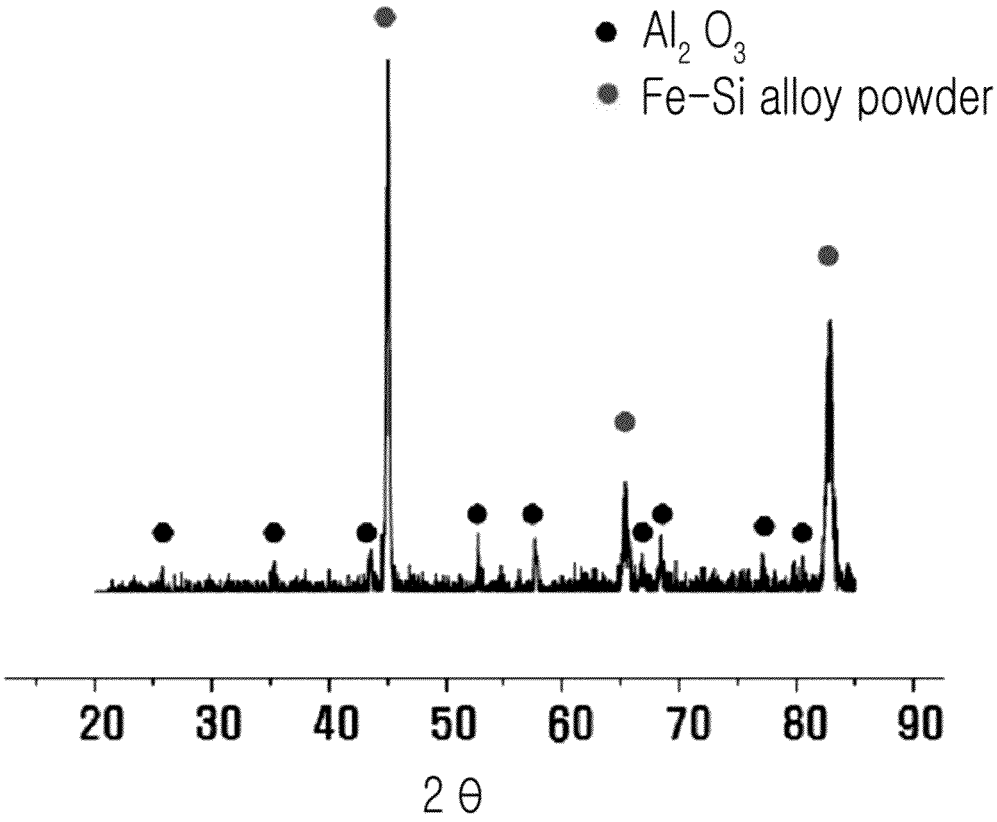
FIG. 6 is an X-ray diffraction graph of a Fe—Si alloy powder manufactured according to a first comparative example.

FIG. 6 is an X-ray diffraction graph of a material manufactured according to the above-stated comparative example.

As shown in FIG. 6, the material includes a Fe—Si alloy powder having a body centered cubic (bcc) structure and alumina in α-phase. That is, the Fe—Si alloy powder is not completely separated from the mixture. Thus, in order to acquire the Fe—Si alloy powder that is completely separated from the mixture, the material should be treated with alkali.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing a Fe—Si alloy powder, comprising:

providing a mixture of an $Al_2O_3$ powder, an active agent powder, a Si powder, and a Fe powder;

heating the mixture with a temperature of 700° C. to 1200° C. in a hydrogen atmosphere;

magnetically separating a Fe-containing material from the mixture; and separating a Fe—Si alloy powder by soaking the Fe-containing material in an alkali solution, wherein in the heating of the mixture, the Si powder is deposited on the surface of the Fe powder and diffused into the Fe powder and wherein the active agent powder includes at least one of compounds selected from a group consisting of an alkali metal fluoride, an alkaline earth metal fluoride, $NH_4F$, $AlF_3$, and $CuF_2$, and the amount of the active agent powder in the mixture is 0.1 wt % to 5.0 wt %.

2. The method of claim 1, wherein, in the providing of the mixture, the amount (wt %) of the Si powder with respect to the sum of the amount (wt %) of the Fe powder and the amount (wt %) of the Si powder is 0.001 to 0.34.

3. The method of claim 1, wherein the amount (wt %) of the Fe powder with respect to the amount (wt %) of the Al2O3 powder is 0.5 to 2.0.

4. The method of claim 1, wherein, in the separating of the Fe—Si alloy powder, alkali included in the alkali solution includes at least one of compounds selected from a group consisting of NaOH and KOH.

5. The method of claim 4, wherein the concentration degree of the alkali in the alkali solution is 0.1 wt % to 40 wt %.

6. A method for manufacturing a Fe—Si alloy powder, comprising:

providing a mixed powder of an inactive powder, a fluoride active agent powder, a Si powder, and a Fe powder;

heating the mixed powder in a hydrogen atmosphere;

cooling the heated mixed powder; and separating a Fe—Si alloy powder from the mixed powder by size distributing and magnetic separation and wherein the inactive powder is at least one of compounds selected from a group consisting of $Al_2O_3$, $SiO_2$, MgO, and $Si_3N_4$, and the particle size of the inactive powder is smaller than that of the Fe powder, and wherein the fluoride active agent powder is at least one of compounds selected from a group consisting of an alkali metal fluoride an alkaline earth metal fluoride $NH_4F$, $AlF_3$, and $CuF_2$, and the amount of fluoride active agent powder is 0.1 wt % to 5 wt % of the mixed powder.

7. The method of claim 6, wherein the amount of the fluoride active agent powder is 3 wt % to 4 wt % of the mixed powder.

8. The method of claim 6, wherein, in the providing of the mixed powder, a ratio of the mass of the Si powder with respect to the sum of the mass of the Si powder and the mass of the Fe powder is 0.001 to 0.34.

9. The method of claim 8, wherein, in the separating of the Fe—Si alloy powder from the mixed powder, the amount of Si in the Fe—Si alloy powder is 0.1 wt % to 34 wt %.

10. The method of claim 6, wherein, in the providing of the mixed powder, a ratio of the mass of the inactive powder with respect to the mass of the Fe powder is 0.5 to 2.0.

11. The method of claim 6, wherein, in the heating of the mixed powder in the hydrogen atmosphere, the mixed powder is heated with a temperature of 700° C. to 1200° C.

* * * * *